US010322830B2

(12) United States Patent
Höhn et al.

(10) Patent No.: US 10,322,830 B2
(45) Date of Patent: Jun. 18, 2019

(54) METHOD FOR ACTUATING THE BAND DRIVING DEVICE OF A STRAPPING MACHINE AND CORRESPONDING STRAPPING MACHINE

(75) Inventors: Jürgen Höhn, Bad Berneck (DE); Jochen Witzgall, Untersteinach (DE); Jürgen Schödel, Gefrees (DE)

(73) Assignee: SMB SCHWEDE MASCHINEBAU GMBH, Goldkronach (DE)

( * ) Notice: Subject to any disclaimer, the term of this patent is extended or adjusted under 35 U.S.C. 154(b) by 1338 days.

(21) Appl. No.: 14/117,027

(22) PCT Filed: May 2, 2012

(86) PCT No.: PCT/EP2012/058027

§ 371 (c)(1),
(2), (4) Date: Dec. 5, 2013

(87) PCT Pub. No.: WO2012/152626

PCT Pub. Date: Nov. 15, 2012

(65) Prior Publication Data

US 2014/0083310 A1 Mar. 27, 2014

(30) Foreign Application Priority Data

May 11, 2011 (DE) ..... 10 2011 075 629

(51) Int. Cl.
*B65B 13/18* (2006.01)
*B65B 57/04* (2006.01)

(52) U.S. Cl.
CPC ..... *B65B 13/18* (2013.01); *B65B 57/04* (2013.01); *B65B 2210/12* (2013.01)

(58) Field of Classification Search
CPC .... B65B 13/18; B65B 57/004; B65B 2210/12
(Continued)

(56) References Cited

U.S. PATENT DOCUMENTS 4,912,912 A * 4/1990 Tagomori ..... B65B 13/18 100/29
5,083,412 A * 1/1992 Sakaki ..... B65B 13/18 100/2

(Continued)

FOREIGN PATENT DOCUMENTS

DE 29822344 3/1999
DE 60318160 T2 12/2008

(Continued)

OTHER PUBLICATIONS

Annotated Applicant Admitted Prior Art (AAPA), exerpt of pp. 1-4 of the specification.*

(Continued)

*Primary Examiner* — Shelley M Self
*Assistant Examiner* — Joseph Finan
(74) *Attorney, Agent, or Firm* — Neal, Gerber & Eisenberg LLP

(57) ABSTRACT

A strapping machine configured for and method for actuating the belt drive mechanism of a strapping machine during a loss of band carrying out the following steps of polling the detector as to a proper shooting of the strapping band in the shooting direction up until the end of the shooting trajectory, and for an improper shooting of the strapping band, activating the shooting and retrieval unit to retrieve the strapping band with a definite retrieval speed for a defined retrieval time so that the strapping band emerges from the shooting and retrieval unit opposite the shooting direction, and actuating the drive of the back-tensioning unit so that the back-tensioning unit transports the strapping band back into the shooting and retrieval unit in the shooting direction.

19 Claims, 3 Drawing Sheets

(58) Field of Classification Search
USPC ..... 100/2, 4
See application file for complete search history.

(56) References Cited

U.S. PATENT DOCUMENTS

| | | | | |
|---|---|---|---|---|
| 5,111,634 | A | 5/1992 | Rauch | |
| 5,299,407 | A * | 4/1994 | Schuttler | B65H 67/02 100/26 |
| 5,333,438 | A * | 8/1994 | Gurak | B65B 13/06 100/24 |
| 5,379,576 | A * | 1/1995 | Koyama | B65B 13/22 100/26 |
| 5,560,187 | A * | 10/1996 | Nagashima | B65B 13/04 100/26 |
| 5,791,238 | A | 8/1998 | Garbotz | |
| 6,032,440 | A * | 3/2000 | Ludtke | B65B 13/22 100/32 |
| 6,041,698 | A * | 3/2000 | Chin-Chang | B65B 13/22 100/26 |
| 6,173,557 | B1 * | 1/2001 | Kuei | B65B 13/184 100/26 |
| 6,334,563 | B1 | 1/2002 | Schwede | |
| 6,401,764 | B1 | 6/2002 | Bell, Jr. | |
| 6,405,917 | B1 | 6/2002 | Mann | |
| 6,463,848 | B1 | 10/2002 | Haberstroh et al. | |
| 6,478,065 | B1 | 11/2002 | Haberstroh et al. | |
| 6,532,722 | B2 | 3/2003 | Gerhart et al. | |
| 6,543,341 | B2 | 4/2003 | Lopez | |
| 6,571,531 | B2 | 6/2003 | Kasel | |
| 6,575,086 | B2 | 6/2003 | Pearson et al. | |
| 6,584,892 | B2 | 7/2003 | Flaum et al. | |
| 6,607,158 | B1 * | 8/2003 | Fischer | B65B 13/18 242/420.1 |
| 6,629,398 | B2 | 10/2003 | Pearson et al. | |
| 6,708,606 | B1 | 3/2004 | Bell, Jr. et al. | |
| 6,745,677 | B2 | 6/2004 | Pearson et al. | |
| 6,820,402 | B1 | 11/2004 | Haberstroh et al. | |
| 6,848,241 | B2 | 2/2005 | Lopez | |
| 6,857,252 | B2 | 2/2005 | Haberstroh et al. | |
| 6,871,584 | B2 | 3/2005 | Pearson | |
| 6,904,841 | B2 | 6/2005 | Bobren et al. | |
| 6,911,799 | B2 | 6/2005 | Jensen | |
| 6,923,113 | B2 | 8/2005 | Bobren et al. | |
| 6,935,227 | B2 | 8/2005 | Lopez et al. | |
| 6,945,164 | B2 | 9/2005 | Kobiella et al. | |
| 6,955,119 | B2 | 10/2005 | Bobren et al. | |
| 6,962,109 | B2 | 11/2005 | Bobren et al. | |
| 6,981,353 | B2 | 1/2006 | Haberstroh et al. | |
| 7,007,597 | B1 | 3/2006 | Thas et al. | |
| 7,121,193 | B2 | 10/2006 | Balling et al. | |
| 7,234,394 | B1 | 6/2007 | Bell, Jr. et al. | |
| 7,237,478 | B1 | 7/2007 | Gosis et al. | |
| 7,270,055 | B1 | 9/2007 | Haberstroh et al. | |
| 7,377,213 | B1 | 5/2008 | Haberstroh et al. | |
| 7,383,765 | B2 | 6/2008 | Kirar et al. | |
| 7,395,754 | B1 | 7/2008 | Bobren et al. | |
| 7,428,865 | B1 | 9/2008 | Kasel et al. | |
| 7,428,867 | B1 | 9/2008 | Bell, Jr. | |
| 7,454,877 | B2 | 11/2008 | Morrison | |
| 7,681,496 | B2 | 3/2010 | Takidis et al. | |
| 7,798,060 | B2 | 9/2010 | Pearson et al. | |
| 7,861,649 | B2 | 1/2011 | Bobren et al. | |
| 8,516,780 | B2 | 8/2013 | Derks | |
| 8,607,695 | B2 | 12/2013 | Schwede | |
| 8,904,925 | B2 | 12/2014 | Haberstroh et al. | |
| 9,296,501 | B2 | 3/2016 | Haberstroh et al. | |
| 2003/0010225 | A1 * | 1/2003 | Pearson | B65B 13/06 100/26 |
| 2004/0060259 | A1 * | 4/2004 | Shibazaki | B65B 13/18 53/399 |
| 2004/0255552 | A1 * | 12/2004 | Haberstroh | B65B 13/04 53/64 |

FOREIGN PATENT DOCUMENTS

| | | |
|---|---|---|
| EP | 1489005 | 12/2004 |
| EP | 1489009 | 12/2004 |
| JP | 01-213109 A | 8/1989 |
| JP | 4627598 | 8/2002 |
| JP | 4095817 | 10/2003 |
| JP | 4405220 | 4/2005 |
| JP | 4366208 | 9/2005 |
| JP | 4814577 | 3/2007 |
| JP | 5298088 | 3/2012 |
| WO | 2004/039676 | 5/2004 |

OTHER PUBLICATIONS

European Patent Office, as International Searching Authority, International Search Report and Written Opinion (in German with English Translation) dated Nov. 19, 2012 in Application No. PCT/EP2012/058027 (13 pages).

* cited by examiner

METHOD FOR ACTUATING THE BAND DRIVING DEVICE OF A STRAPPING MACHINE AND CORRESPONDING STRAPPING MACHINE

CROSS-REFERENCE TO RELATED APPLICATIONS

This application claims priority in German Patent Application, Serial No. 10 2011 075 629.9, filed May 11, 2011, pursuant to 35 U.S.C. 119(a)-(d), the content of which is incorporated herein by reference in its entirety as if fully set forth herein.

FIELD OF THE INVENTION

The present invention concerns a method for actuating a belt drive mechanism of a strapping machine during a loss of a strapping band in its shooting and retrieval unit, where the strapping machine includes a shooting and retrieval unit with at least a first pair of rollers, between which the band can be driven through by at least one of the rollers in and against the shooting direction of the band, a detector for detecting a leading end of the band at an end of the shooting trajectory, and a back tensioning unit arranged behind the shooting and retrieval unit in regard to the shooting direction with a second pair of rollers, between which the band can be tensioned by at least one of the rollers against the shooting direction around an item being strapped in the strapping machine, as well as a strapping machine with a correspondingly controlled band drive mechanism.

BACKGROUND OF THE INVENTION

A strapping machine is known, for example, from DE 196 02 579 A1. Besides the familiar parts that are present in such machines, such as machine frame, work bench, and band guide frame for leading the strapping band around the object being strapped as a loose loop, it has a band drive unit placed underneath the work bench. This comprises a combined shooting and retrieval unit for shooting the strapping band into the band guide frame and retrieving the strapping band from the band guide frame until the strapping band bears against the object being strapped. Moreover, a back-tensioning mechanism is often present for tightening the strapping band about the object, being dependent on the stack height.

The shooting and retrieval unit has at least one pair of rollers, between the gap of which the strapping band is led through by one of the rollers in the shooting and retrieval direction. The back-tensioning unit has another pair of rollers, between the gap of which the strapping band is likewise fed and can be clamped around the item being strapped in the machine by at least one of the rollers in the retrieval direction.

Finally, guide channel sections are provided to guide the strapping band through the band drive mechanism, which lead the strapping band brought up from a supply roll or a temporary storage device to the back-tensioning mechanism, between the latter and the shooting and retrieval unit, and from the latter in the direction of the band frame on the work bench. The guide channel sections are formed by cheeks which guide the strapping band on either of its flat sides, being configured as webs or side surfaces of larger prismatic bodies.

A typical problem in the operation of such a strapping machine sometimes occurs due to a faulty handling of the strapping band. Thus, for example, the leading end of the band cannot reach the welding head due to obstacles in the band guide frame and therefore the detector situated here, for example, in the form of an end switch, is not activated to detect the leading end of the band at the end of its shooting trajectory in the band guide frame. The control system of the strapping machine recognizes this and it then arranges for a retrieval of the strapping band, usually until it emerges backward from the pair of drive rollers of the band drive mechanism opposite the shooting direction.

This fault situation is normally monitored by a sensing mechanism, which detects the condition when the strapping band emerges from the shooting and retrieval unit opposite the shooting direction.

To remedy the fault in the strapping machines known thus far it was necessary to open the band drive mechanism and manually thread the strapping band into the shooting and retrieval unit, so that the shooting process can start over again. This leads to a substantial down time for the strapping machine, which is basically undesirable and in an extreme case can lead to a shutdown of the entire production line when the strapping machine is integrated as part of a continuous production process for print products, for example.

In EP 1 489 005 A2 a corresponding method is indicated for actuating a band drive mechanism that can eliminate the described fault situation without manual intervention in substantially less time. According to this, the back-tensioning mechanism can be reversed in its drive direction so that when a fault is detected—that is, a band loss in the shooting and retrieval unit—the strapping band is transported back almost automatically to the shooting and retrieval unit.

A drawback with this control method is the fact that the fault situation and the driving of the band must be detected by means of a suitable sensor, e.g., an incremental encoder on the pressing roller of the shooting and retrieval unit. This signal is then further processed in the control program and incorporated into the control sequence. This requires additional expense for control technology and apparatus.

This drawback is even more glaring for the strapping machine of DE 603 18 160 T2, which is different in its design makeup of shooting, retrieval and back-tensioning unit. Here, the band length that was shot out and retrieved in the fault situation is detected and the band is pulled back with two different band speeds to the starting position before being threaded once again.

SUMMARY OF THE INVENTION

Accordingly, the problem to which the invention is directed is to provide a simplified yet reliable actuation method for the band drive mechanism of a strapping machine to eliminate the above described fault situation.

This problem is solved by the steps of the method indicated below:

- polling the detector for detecting the leading end of the band as to a proper shooting of the strapping band in the shooting direction up till the end of the shooting trajectory,
- for an improper shooting of the strapping band, activating the shooting and retrieval unit to retrieve the strapping band with a definite retrieval speed for a defined retrieval time so that the strapping band emerges from the shooting and retrieval unit opposite the shooting direction, and actuating the drive of the back-tensioning unit so that the back-tensioning unit transports the strapping band back into the shooting and retrieval unit in the shooting direction.

Thanks to the method of the invention, it is possible to eliminate the separate detector in the area of the shooting and retrieval unit, since it is no longer necessary to actively detect the presence of the strapping band in the pair of rollers there. Instead, the timing control of the retrieval of the strapping band with a defined retrieval speed assures the reliable emergence of the strapping band from the pair of driving rollers. Since the back tensioning unit is opened and thus inactive during the retrieval of the strapping band with the aid of the shooting and retrieval unit, the strapping band also stops as soon as it has left the shooting and retrieval unit. This occurs regardless of whether the latter is still being driven. Thus, the strapping band is available with certainty for reintroducing into the shooting and retrieval unit with the aid of the back tensioning unit, which runs in its driving direction opposite the tensioning direction.

As is evident from the foregoing, the described fault situation is reliably corrected without manual intervention in the band drive mechanism by means of a simplified design for the drive engineering.

Features, details and benefits of the method of actuation of the invention and a corresponding band drive mechanism will emerge from the following description of an exemplary embodiment.

DETAILED DESCRIPTION OF AT LEAST ONE PREFERRED EMBODIMENT

Figure 1:
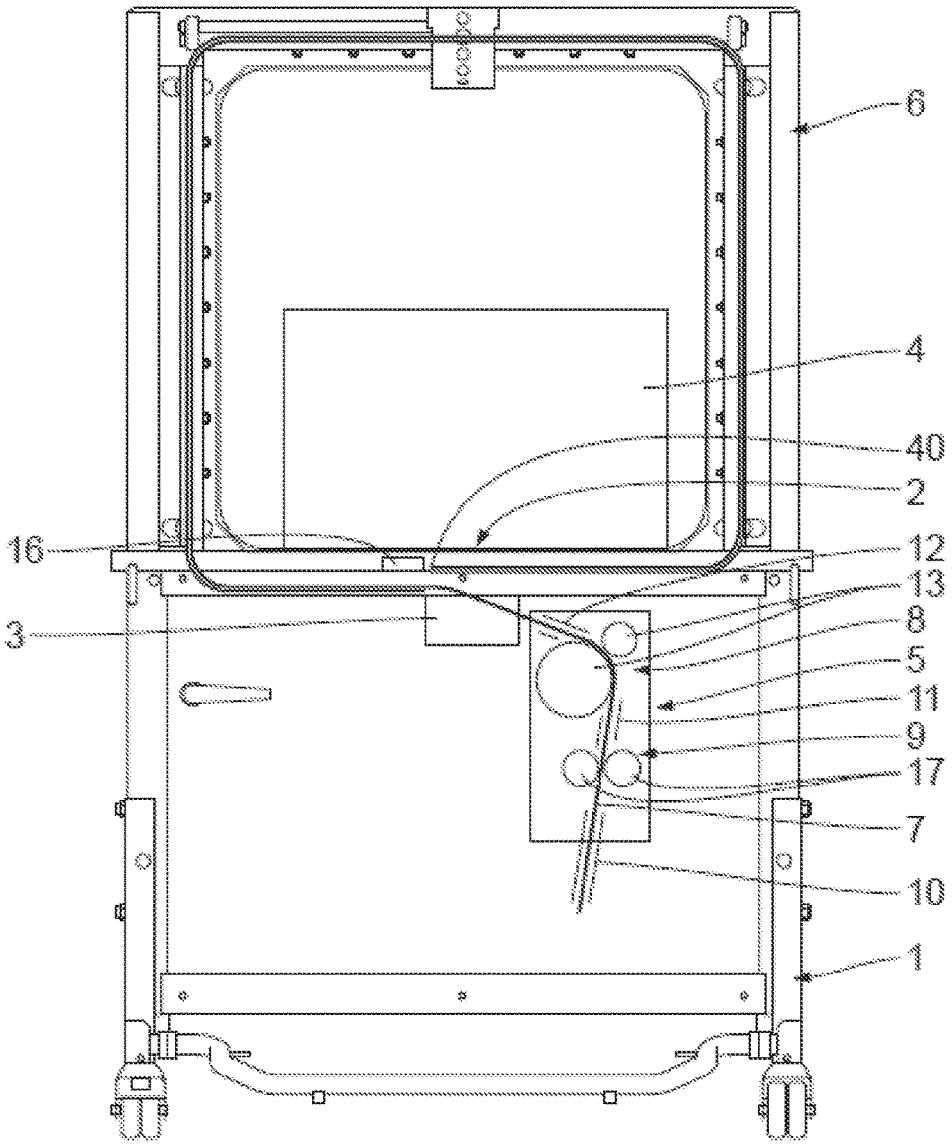
FIG. 1 a schematic side view of a strapping machine.

As is shown by FIG. 1, the strapping machine has a machine frame 1 mounted on rollers, on which is arranged a work bench 2. The work bench 2 has conveyor belts (not shown), by means of which the objects 4 being strapped, such as a stack of newspapers in FIG. 1, is transported into the strapping position on the work bench 2. For so-called cross strapping, a turntable can also be integrated in the work bench 2, as is found in EP 0 445 429 B1.

On the work bench 2 is arranged a vertically upright band guide frame 6, by means of which the strapping band 7 can be led as a loose loop around the object 4 on the work bench 2. For this, the strapping band 7 stored on a supply roll not otherwise depicted at the side of the machine frame 1 is shot by the band drive mechanism 5 shown only schematically in FIG. 1 underneath the work bench 2 through the welding head 3 of the strapping machine into the band guide frame 6 forming the shooting trajectory and led around it until it again arrives at the welding head 3. The detector arranged there at the end of the shooting trajectory in the form of an end switch 16 detects the proper arrival of the strapping band 7. The end of the band is fixed there and then the strapping band 7 is retrieved with the aid of the band drive mechanism 5, whereupon it emerges from the band guide frame 6 and lies around the object 4 as a still un-tensioned loop. Next, with the aid of the band drive mechanism 5, the band is tensioned and thus lies firmly about the object 4. The band layers overlapping in the welding head 3 are heat welded, for example, and the resulting product is separated from the supplied strapping band. The object 4 is now strapped and can be transported away.

Figure 2:
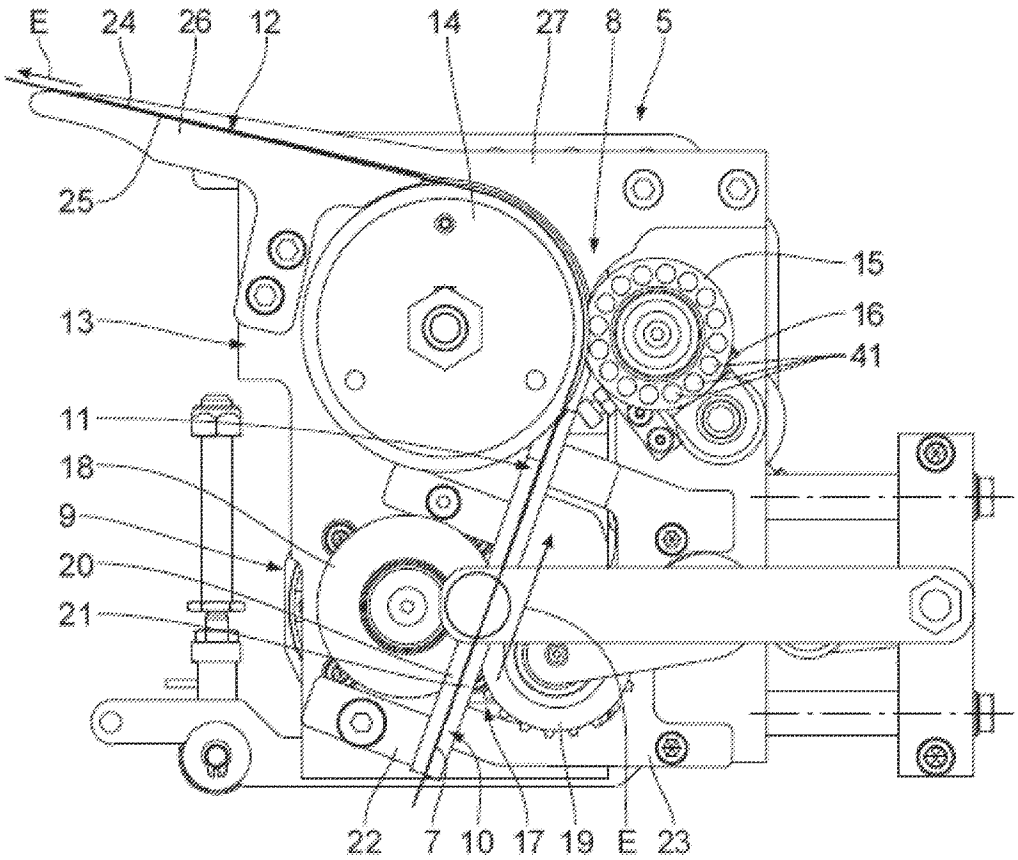
FIGS. 2 and 3 are schematic side views of the band drive mechanism of this strapping machine in different positions of the strapping band.

FIG. 2 will explain the layout of the band drive mechanism 5. The basic subassemblies are, first, the shooting and retrieval unit 8 and, secondly, the back tensioning unit 9, which perform the above mentioned band manipulations according to their designation.

Guide channel sections 10, 11, 12 are provided to form a defined transport path for the strapping band 7 through the band drive mechanism 5. A first guide channel section 10 leads the strapping band 7 from the supply roll or interim storage (neither being shown) to the back tensioning unit 9. A second guide channel section 11 connects the back tensioning unit 9 and the shooting and retrieval unit 8. A last guide channel section 12 goes from the shooting and retrieval unit 8 in the direction of the welding head 3 and to the point of entry of the strapping band 7 into the band guide frame 6.

The shooting and retrieval unit 8 has a drive roller pair 13 with a roller 14 driven by a motor (not shown) and a non-driven pressure roller 15.

For the shooting of the strapping band 7, the roller 14 of the drive roller pair 13 is set turning in the proper direction via the actuation of the drive motor by a control unit (not shown) and the strapping band 7 is taken around in the band guide frame 6 until its leading end 40 with detection by the end switch 16 comes to lie in the region of the welding head 3 and is fixed there. After this, the drive roller pair 13 is activated in the opposite direction and in this way the strapping band 7 is retrieved, as described above, until it is laid basically with no tension about the object 4 being strapped.

The back tensioning unit 9 has a tension roller pair 17 with interconnected rollers 18, 19, which then applies a large tractive force with the aid of its drive motor (not shown) for the back tensioning of the strapping band 7 about the object 4 being strapped.

The guide channel sections 10, 11 are formed by web-like cheeks 20, 21 jointly led away across the rollers 18, 19, which are fixed by projecting support feet 22, 23 in a manner to be explained below in the band drive mechanism 5. The rollers 18, 19 reach through recesses in the cheeks 20, 21, not otherwise shown in the drawing.

The guide channel section 12 is likewise formed by cheeks 24, 25 on either side, the one cheek 24 being formed by the side surface of a prismatic body 26 that is roughly T-shaped in top view. The other cheek 25 is formed to be curved in a curved section corresponding to the outer circumference of the roller 14 by a strapping angle for the strapping band 7 and then continues in a straight section. It is formed as a side surface on a corresponding elongated prismatic body 27.

In what follows, the above mentioned fault situation will be explained by means of a sample embodiment. The triggering event is the fact that the end switch 16 does not respond in the time defined for the shooting of the strapping band 7 in the machine control unit, of say 0.2 seconds. This is a signal that the strapping band 7 has not reached the welding head 3 with its leading end 40. Based on this fault recognition, the shooting and retrieval unit 8 is activated so that the strapping band 7 is transported back against the shooting direction E with a substantially lower retrieval speed than for the shooting process. The retrieval time is defined so that the strapping band 7 is pulled with certainty completely out of the shooting path and the shooting and retrieval unit 8. In this way, the strapping band 7 stops with its leading end 40 between the latter and the back tensioning unit 9.

The retrieval time can also be defined variably by a kind of self-learning system, in that the retrieval time is determined by deriving the required time from the previous shooting in direct proportionality to the reduced retrieval speed.

Figure 3:
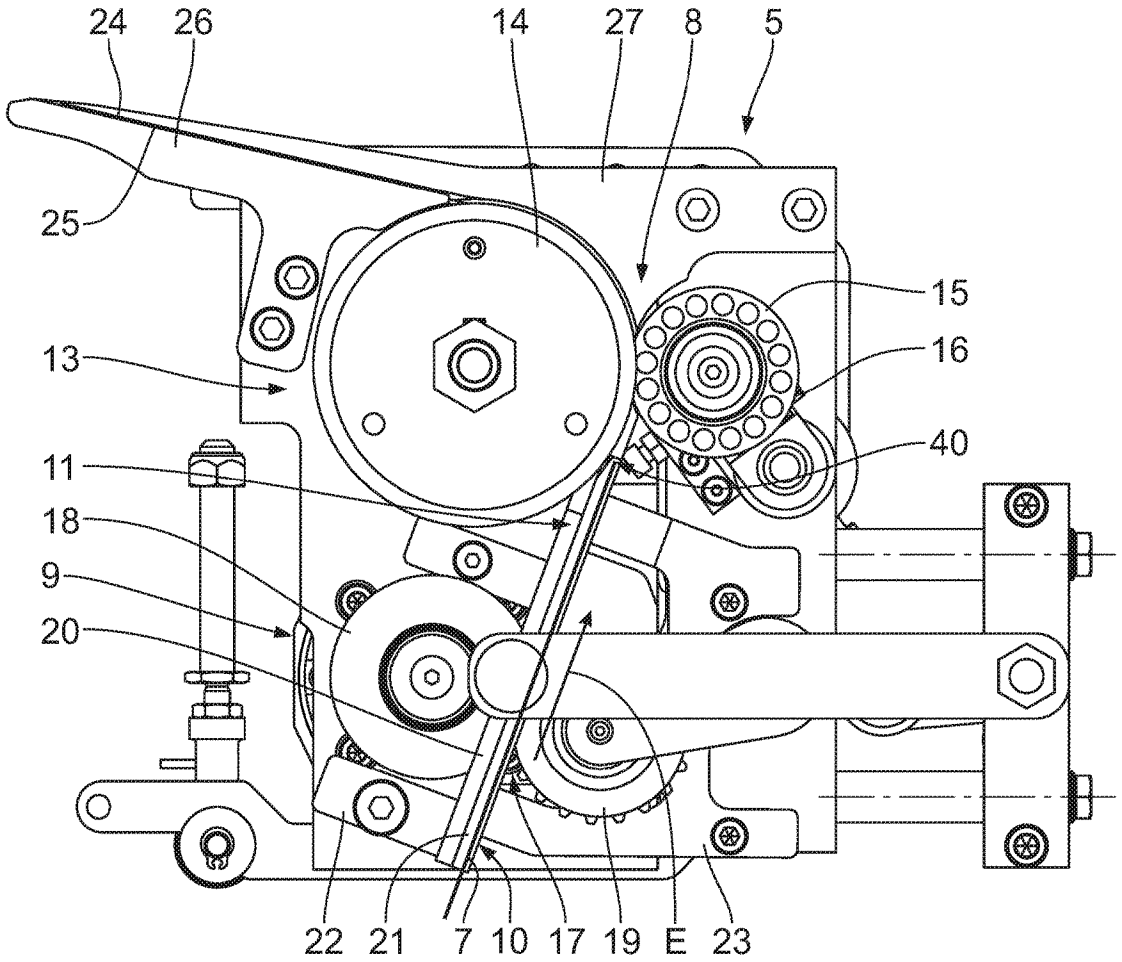

The control system of the strapping machine, not otherwise described, then activates the back tensioning unit 9 against its normal back tensioning direction, which is opposite the shooting direction E. For this, the roller 18 of the tension roller pair 17 is set moving counterclockwise, so that the strapping band 7 is again transported in the shooting direction E from the position shown in FIG. 3 upward in the roller gap of the drive roller pair 13 of the shooting and retrieval unit 8. This takes up the leading end 40 of the strapping band 7 once again. By a corresponding activation of the drive roller 14 of the shooting and retrieval unit 8, the strapping band 7 is again shot into the band guide frame 6. Then the drive of the back tensioning unit 9 can be deactivated once more.

What is claimed is:

1. A strapping machine comprising:

a frame;

a strapping band guide supported by the frame;

a shooting-and-retrieval unit supported by the frame and comprising a first drive roller and a first motor operably connected to the first drive roller to drive the first drive roller;

a back-tensioning unit supported by the frame and comprising a second drive roller and a second motor operably connected to the second drive roller to drive the second drive roller;

a detector configured to detect a leading end of a strapping band; and a controller configured to:

actuate the first motor to drive the first drive roller to move the strapping band in a feed direction at a feed speed such that the leading end of the strapping band enters the strapping band guide; and responsive to the detector failing to detect the leading end of the strapping band within a designated time period following the actuation of the first motor:

determine a retrieval time based on a designated retrieval speed and an amount of time the first motor was actuated;

actuate the first motor to drive the first drive roller to move the strapping band in a retraction direction opposite the feed direction at the designated retrieval speed for the retrieval time such that the leading end of the strapping band is withdrawn from the shooting-and-retrieval unit; and afterwards, actuate the second motor to drive the second drive roller to move the strapping band in the feed direction such that the leading end of the strapping band is received in the shooting-and-retrieval unit.

2. The strapping machine of claim 1, further comprising a welding head supported by the frame, wherein the controller is further configured to, responsive to the detector detecting the leading end of the strapping band within the designated time period following the actuation of the first motor:

control the welding head to hold the leading end of the strapping band;

actuate the first motor to drive the first drive roller to move the strapping band in the retraction direction to withdraw the strapping band from the strapping band guide to form an untensioned loop of the strapping band around an object to-be-strapped;

actuate the second motor to drive the second drive roller to move the strapping band in the retraction direction to tension the strapping band around the object; and control the welding head to attach the leading end of the strapping band to another portion of the strapping band to form a tensioned loop of the strapping band around the object.

3. The strapping machine of claim 1, where in the controller is further configured to, after the leading end of the strapping band is received in the shooting-and-retrieval unit, actuate the first motor to drive the first drive roller to again move the strapping band in the feed direction such that the leading end of the strapping band again enters the strapping band guide.

4. The strapping machine of claim 1, wherein the designated retrieval speed is less than the feed speed.

5. The strapping machine of claim 1, wherein the designated retrieval speed is no greater than 50% of the feeding speed.

6. The strapping machine of claim 5, wherein the designated retrieval speed is between 10% and 20% of the feeding speed.

7. The strapping machine of claim 1, wherein the controller is configured to drive the first drive roller in a first rotational direction to move the strapping band in the feed direction and to drive the first drive roller in a second rotational direction opposite the first rotational direction to move the strapping band in the retraction direction.

8. The strapping machine of claim 1, wherein the controller is configured to drive the second drive roller in a first rotational direction to move the strapping band in the feed direction and to drive the second drive roller in a second rotational direction opposite the first rotational direction to move the strapping band in the retraction direction.

9. The strapping machine of claim 8, wherein the controller is configured to drive the first drive roller in the first rotational direction to move the strapping band in the feed direction and to drive the first drive roller in the second rotational direction to move the strapping band in the retraction direction.

10. The strapping machine of claim 1, wherein the shooting-and-retrieval unit further comprises a first driven roller positioned such that the strapping band is receivable between the first drive roller and the first driven roller.

11. The strapping machine of claim 10, wherein the back-tensioning unit further comprises a second driven roller positioned such that the strapping band is receivable between the second drive roller and the second driven roller.

12. The strapping machine of claim 11, wherein a strapping band guide channel is defined between the first drive and driven rollers and the second drive and driven rollers.

13. The strapping machine of claim 12, wherein the controller is further configured to actuate the first motor to drive the first drive roller to move the strapping band in the retraction direction opposite the feed direction at the designated retrieval speed for the retrieval time such that the leading end of the strapping band is withdrawn from the shooting-and-retrieval unit and positioned in the strapping band guide channel.

14. The strapping machine of claim 13, wherein the controller is configured to drive the second drive roller in a first rotational direction to move the strapping band in the feed direction and to drive the second drive roller in a second rotational direction opposite the first rotational direction to move the strapping band in the retraction direction.

15. The strapping machine of claim 14, wherein the controller is configured to drive the first drive roller in the first rotational direction to move the strapping band in the feed direction and to drive the first drive roller in the second rotational direction to move the strapping band in the retraction direction.

16. The strapping machine of claim 15, wherein the controller is further configured to, after the leading end of the strapping band is received in the shooting-and-retrieval unit, actuate the first motor to drive the first drive roller to again move the strapping band in the feed direction such that the leading end of the strapping band again enters the strapping band guide.

17. The strapping machine of claim 16, wherein the designated retrieval speed is less than the feed speed.

18. The strapping machine of claim 1, wherein the controller is further configured to actuate the first motor to drive the first drive roller to move the strapping band in the retraction direction opposite the feed direction at the designated retrieval speed for the retrieval time such that the leading end of the strapping band is withdrawn from the shooting-and-retrieval unit and positioned in a strapping band guide channel between the shooting-and-retrieval unit and the back-tensioning unit.

19. The strapping machine of claim 1, wherein the controller is configured to determine the retrieval time based solely on the designated retrieval speed and the amount of time the first motor was actuated.

* * * * *